United States Patent [19]

Nash

[11] Patent Number: 4,658,997

[45] Date of Patent: Apr. 21, 1987

[54] DISPLAY HANGER COVER

[76] Inventor: Stacy B. Nash, P.O. Box 5476, Destin, Fla. 32541

[21] Appl. No.: 833,983

[22] Filed: Feb. 26, 1986

Related U.S. Application Data

[63] Continuation-in-part of Ser. No. 716,763, Mar. 27, 1985, abandoned.

[51] Int. Cl.[4] ..... A47G 25/20; A47G 25/30

[52] U.S. Cl. ..... 223/98; D6/328

[58] Field of Search ..... 223/85, 87, 88, 92, 223/98, 86; 40/322; D6/315, 318, 319, 328

[56] References Cited

U.S. PATENT DOCUMENTS

| | | | |
|---|---|---|---|
| D. 101,127 | 9/1936 | Linney . | |
| D. 162,048 | 2/1951 | Lynch . | |
| 428,166 | 5/1890 | Doe . | |
| 847,329 | 3/1907 | Gebhardt . | |
| 1,101,421 | 6/1914 | Falk . | |
| 1,643,077 | 9/1927 | Levkoff . | |
| 1,786,341 | 12/1930 | Gilbert . | |
| 2,042,846 | 6/1936 | Hoffman . | |
| 2,062,566 | 12/1936 | Fletcher et al. . | |
| 2,114,803 | 4/1938 | Kurucz et al. | 223/88 |
| 2,137,824 | 11/1938 | Rader . | |
| 2,353,839 | 7/1944 | McFall . | |
| 2,420,101 | 5/1947 | Samann . | |
| 2,448,282 | 8/1948 | Schmitt . | |
| 2,622,775 | 12/1952 | Sasaki . | |
| 2,630,254 | 3/1953 | Rice . | |
| 2,649,229 | 8/1953 | Sutter . | |
| 2,675,948 | 4/1954 | Mallory . | |
| 2,824,679 | 2/1958 | Gale . | |
| 2,891,705 | 6/1959 | Gray . | |
| 3,029,005 | 4/1962 | Batts . | |
| 3,032,243 | 5/1962 | Furno . | |
| 3,033,430 | 5/1962 | Zintel . | |
| 3,167,224 | 1/1965 | Landers . | |
| 3,294,296 | 12/1966 | Gelman et al. . | |
| 3,301,447 | 1/1967 | Felton . | |
| 3,535,808 | 10/1970 | Morrish . | |
| 3,733,016 | 5/1973 | Rood . | |
| 3,762,614 | 10/1973 | Musante . | |
| 3,847,314 | 11/1974 | Florian . | |
| 4,026,447 | 5/1977 | Wnek . | |
| 4,045,899 | 9/1977 | Richardson . | |
| 4,160,516 | 7/1979 | Rice . | |

FOREIGN PATENT DOCUMENTS

| | | |
|---|---|---|
| 923416 | 2/1947 | France . |
| 1121265 | 4/1956 | France . |
| 1537858 | 7/1968 | France . |
| 1111063 | 4/1968 | United Kingdom . |

*Primary Examiner*—Robert R. Mackey

*Attorney, Agent, or Firm*—Bill D. McCarthy

[57] ABSTRACT

An improved display hanger cover supportable by a clothes hanger to convert the hanger to function as a display hanger for supporting a garment, comprising an elongated body portion having a hollow interior, substantially curvilinearly shaped front and rear walls, and substantially curvilinearly shaped first and second shoulder portions disposable over the side arms of the clothes hanger. A neck portion is supported at the confluence of the first and second shoulder portions with the front and rear walls, and the neck portion has a substantially planar upper surface through which is provided a hook passage slot communicating with the hollow interior. First and second slot portions of the hook passage slot are shaped to respectively pass and selectively retain the hanger neck portion of the clothes hanger, thus permitting angular adjustment of the clothes hanger within the hollow body portion when the display cover hanger is disposed over the clothes hanger. For stabilizing the display hanger cover on a wire hanger, the neck portion of the display hanger cover is provided with a third slot portion communicating with the second slot portion and disposed substantially parallel to the first slot portion, thus permitting at least a portion of the neck of the wire hanger to extend through the third slot portion for securing and stabilizing the display hanger cover on the wire hanger.

7 Claims, 13 Drawing Figures

DISPLAY HANGER COVER

CROSS REFERENCE TO RELATED APPLICATION

This application is a continuation-in-part application of co-pending patent application, U.S. Ser. No. 716,763, entitled, "DISPLAY HANGER COVER", filed Mar. 27, 1985, now abandoned.

BACKGROUND OF THE INVENTION

1. Field of the Invention.

The present invention relates generally to the area of clothes handling devices, and more particularly but not by way of limitation, to an improved display hanger cover for use in converting conventional clothes hangers to the utility of better garment storage and display.

2. Discussion.

Many prior art attempts have been made at improving the usefulness of basic clothes hangers which are usually made of stiff or semi-stiff wire. While such wire hangers do serve the useful function of supporting and storing garments, such as suit coats, in closets and the like, wire hangers do not provide much shoulder support for the garments, and the slumping appearance of a hanger held suit coat is soon telling as the garment ages. Further, because of the distortion which results in a sweater when supported by a wire hanger, it has become customary that sweaters be stored in a folded condition, either by the retail clothing merchant or in the home of the user.

Even when new, the appearance of garments is enhanced with the use of what is sometimes called as coat hangers, and also sometimes referred to as wishbone hangers. These hangers have curved upper shoulder supports to more nearly approximate actual shoulder support and thus present the hanging garment in closely simulated wearing mode.

Display hangers, which are generally similar to wishbone type hangers except for having much broader shoulder support arms, are especially useful as these hangers give much better support and fullness to a garment. Because of their expense, retail clothing merchants most frequently keep a minor inventory of such display hangers for displaying coats and like garments at display points, such as in windows. The higher cost of a display hanger cannot be justified for the storage and display of the total inventory, so most garments are retained by merchants on wishbone or wire hangers, or as with sweaters, stored for display in a folded condition.

It would be desirable to convert the wishbone and wire hangers to the utility of a display hanger while avoiding the higher cost of the latter type, and this has been achieved, at least for straight bodied clothes hangers, in the prior art use of hanger covers.

One prior art coat hanger cover is taught in U.S. Pat. No. 2,622,775, issued to Sasaki, wherein a coat hanger cover is disposable over a coat hanger. The stated object of this patent is to provide a cover adapted to be fitted over a coat hanger to provide widened portions for the support of the shoulder portions of the coat so that the coat will hang true and be adequately supported upon the hanger. Another teaching of similar import is the patent issued to Rice, U.S. Pat. No. 2,630,254, which provides a garment shield and support that fits over a conventional wire coat hanger. Similarly, the Felton patent, U.S. Pat. No. 3,301,447, provides a garment hanger attachment molded from thermal plastic resin or light metal and which features the attachment disposable over a conventional hanger.

In like manner, similar slip over hanger attachments are found in the patents to Musante, U.S. Pat. No. 3,762,614; Florian, U.S. Pat. No. 3,847,314; Sutter, U.S. Pat. No. 2,649,229; French Pat. No. 1,537,858; United Kingdom Pat. No. 1,111,063; French Pat. No. 923,416; and French Pat. No. 1,121,265. Various other hanger attachments of interest are shown in the following patents: Samann, U.S. Pat. No. 2,420,101; Schmitt, U.S. Pat. No. 2,448,282; Wnek, U.S. Pat. No. 4,026,447; McFall, U.S. Pat. No. 2,353,839; Rader, U.S. Pat. No. 2,137,824; Fletcher et. al., U.S. Pat. No. 2,062,566; and Rice, U.S. Pat. No. 4,160,516.

While it would appear that the general concept of hanger covers or converters is well known in the prior art, there does not appear to be available in such prior art a display hanger cover usable with a variety of support hangers, such as with wishbone hangers and with wire hangers. It would be desirable to have an inexpensive, yet effective, display hanger cover which would provide support and fullness to a garment, such as a suit coat, and which could be used economically to display the major portion of a merchant's inventory at relatively low cost thereto. Further, if such low cost display hanger covers were available, many other garments, such as sweaters, wide shouldered dresses or dresses having weighted shoulder ornaments or supports could be more attractively displayed, both in the retail establishment and in a home wardrobe. The present invention provides such an improved display hanger cover.

SUMMARY OF THE INVENTION

The present invention provides a display cover hanger which is supportable over a clothes hanger and which converts the clothes hanger to the utility, that is the shape, of a display hanger for supporting a garment. The underlying clothes hanger can be characterized as having oppositely disposed side arms, a hanger neck portion supported by the side arms and a hanger hook supported by the upper end of the hanger neck portion. The display hanger cover of the present invention then comprises an elongated body portion having a hollow interior which is open at its bottom, the body portion having substantially curvilinearly shaped front and rear walls disposed so as to be supported over the hanger side arms, and having first and second shoulder portions supported by the front and rear walls.

A neck portion of the display hanger cover is supported at the confluence of the first and second shoulder portions with the front and rear walls, the neck portion having a substantially planar upper surface. Disposed in this planar upper surface is at least one first hook passage slot which communicates with the hollow interior of the body portion, and a first slot portion of the hook passage slot is generally shaped to permit passage therethrough of the profile of the hanger hook portion of the supporting clothes hanger. A second slot portion of the hook passage slot is disposed substantially normal to the first slot portion, with the second slot portion being dimensioned so as to permit passage and selective retention of the hanger neck portion therein. Preferably, the upper planar surface is comprised of a flexible material, the second slot portion of the hook passage slot has a first side wall and a second side wall, and these first and second side walls being separated to an extent that the hanger neck portion is movable along the second slot portion but retainable at points therealong.

Also preferably, the first and second shoulder portions are curvilinear configured to form garment support ramps that substantially support a garment in a simulated wearing mode thereof. And furthermore, it is preferable that the body and neck portions of the display hanger covers are configured so as to be substantially nestable.

It is an object of the present invention to provide an improved display hanger cover which is capable of converting a variety of clothes hangers to the utility of a display hanger for the attractive display and beneficial support of garments such as suit coats, dresses, sweaters and the like.

Another object of the present invention, while achieving the above stated object, is to provide an improved display hanger cover which is more securely attached to and stabilizes the underlying support hanger.

Yet another object of the present invention, while achieving the above stated objects, is to provide an improved display hanger cover which is easily installable and removable, reusable and inexpensive to manufacture.

Other features, advantages and objects of the present invention will become clear from the following detailed description when read in conjunction with the drawings and the appended claims.

DESCRIPTION OF THE INVENTION

Figure 1:
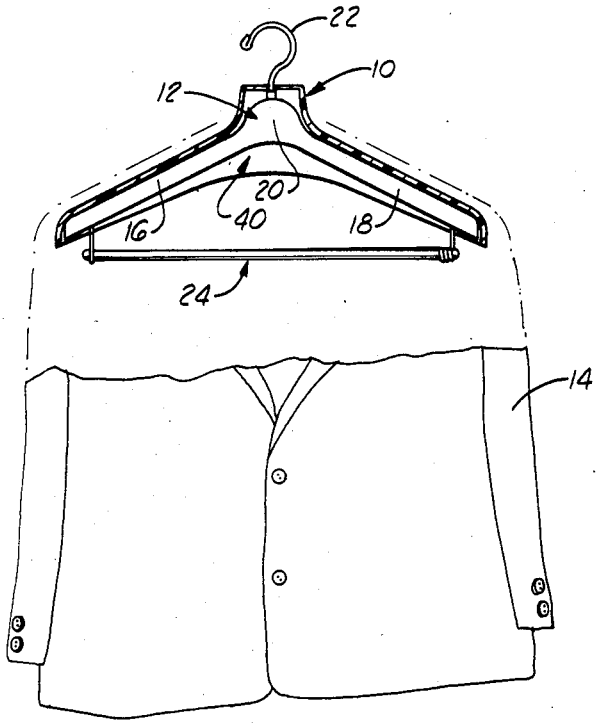
FIG. 1 is a side elevational, partial cutaway view of a wishbone type hanger with a man's suit coat depicted as hanging thereon.

Referring to the drawings in general, and more particularly to FIG. 1, shown therein is a display hanger cover 10 constructed in accordance with the present invention. The display hanger cover 10 is depicted in FIG. 1 in cross sectional, cutaway view in order to show the supporting hanger 12, which is of the type commonly referred to as a coat hanger or, as will be sometimes used herein, a wishbone hanger. A suit coat 14, shown in partial cutaway view, is supported by the combination of the display hanger cover 10 and the wishbone hanger 12.

Figure 2:
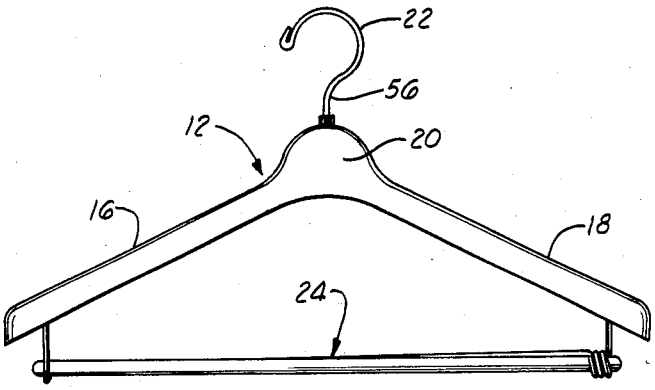
FIG. 2 PRIOR ART
FIG. 2 is a side elevational view of a prior art
Figure 3:
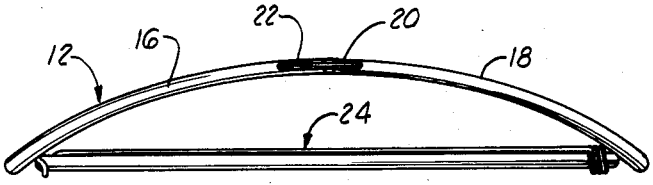
FIG. 3 PRIOR ART
FIG. 3 is a top plan view of the wishbone hanger of FIG. 2.

FIGS. 2 and 3 provide enlarged side and top plan views, respectively, of the wishbone hanger 12. Of course, the wishbone hanger is simply a clothes hanger which is more specifically designed to provide curvilinear, shoulder support for a garment, such as a suit coat 14, and accordingly, the wishbone hanger 12 has oppositely disposed side arms 16 and 18 that meet centrally to form a neck portion 20. The neck portion 20 has an upwardly extensively hanger hook 22. As depicted in FIG. 3, the side arms 16 and 18 are curvilinear configured, and may support a lower carriage assembly 24, if desired, for the support of such garments as pants, slacks or skirts. The top plan view of FIG. 3 shows the planar profile of the hanger hook 22, a term that will become more significant hereinbelow.

Figure 4:
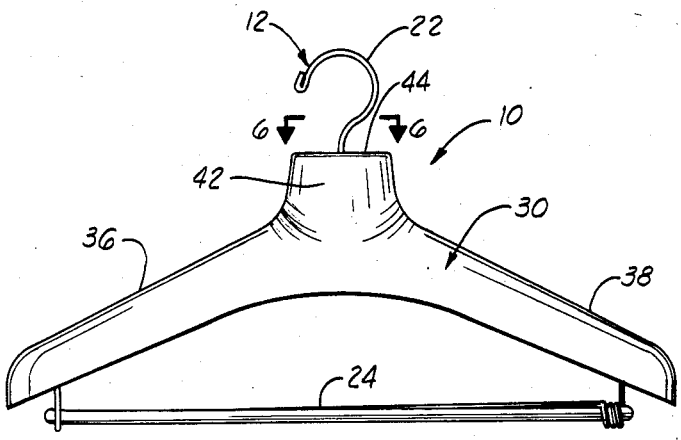
FIG. 4 is a side elevational view showing the display hanger cover of the present invention as supported on the wishbone hanger of FIG. 2.
Figure 5:
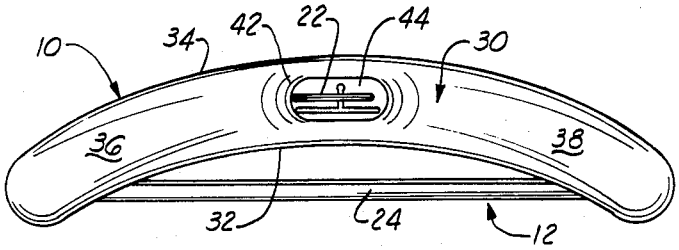
FIG. 5 is a top plan view of the display hanger cover shown in FIG. 4.

Moving to FIGS. 4 and 5, shown therein are side elevational and top plan views, respectively, of the display hanger cover 10 as supported by the wishbone hanger 12. The display hanger cover 10 has an elongated body portion 30 that has a curvilinearly shaped front wall 32 and a similarly shaped rear wall 34 which support oppositely disposed first and second shoulder portions 36 and 38. The body portion 30 has a hollow interior 40 (see FIG. 1) which is open at its bottom, allowing the free entrance of the side arms 16, 18 of the wishbone hanger 12 to assume the position depicted.

The display hanger 10 also has a neck portion 42 which is supported at the confluence of the first and second shoulder portions 36, 38 and the front and rear walls 32, 34 of the body portion 30, and the neck portion 42 has a substantially planar upper surface 44. A hook passage slot 50 is disposed through the upper surface 44 so as to communicate with the hollow interior 40 of the body portion 30. A first slot portion 52 of the hook passage slot 50 is generally shaped for passage therethrough of the planar profile of the hanger hook 22; that is, the first slot portion is a relatively thin, elongated slot which is dimensioned to permit the passage of the hanger hook 22 therethrough as the display hanger cover 10 is being disposed over the wishbone hanger 12, permitting passage of the hanger hook 22 with relative ease therethrough.

Figure 6:
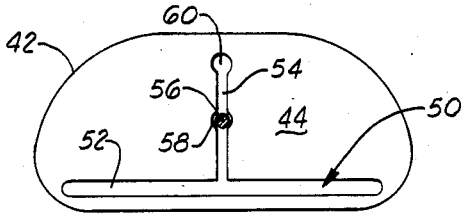
FIG. 6 is an enlarged view of the planar support surface as taken at 6—6 in FIG. 4.

A second slot portion 54 of the hook passage slot 50 communicates with the first slot portion 52 and is generally disposed at a right angle, or normal, thereto. The second slot portion 54 is preferably somewhat more narrow than that of the first slot portion 52 and is such that the upstanding portion 56 of the hanger hook 22 (as shown in cross sectional view in FIG. 6) can be forcibly pushed therealong. In the embodiment of the hook passage slot 50 depicted in FIG. 6, a first relief aperture 58 and a second relief aperture 60 are disposed at spaced apart intervals along the second slot portion 54 and are dimensioned so as to generally receive the cross sectional configuration of the upstanding portion 56 of the hanger hook 22 as shown. These relief apertures (the first and second relief apertures 58, 60) may be dimensioned and positioned so that the display hanger cover 10 will accommodate various configurations of clothes hangers; that is, the size and positioning of the relief apertures are determined so as to selectively establish the angular disposition of the wishbone hanger 12 relative to the display hanger cover 10 when the latter is placed over the former. This permits the hollow interior 40 of the body portion 30 to cover various curvilinear (and even straight) configurations of the side arms 16, 18 of wishbone and other type of hangers, thus permitting the use of the display hanger cover with many types of clothes hangers; including conventional wire hangers.

Figure 7:
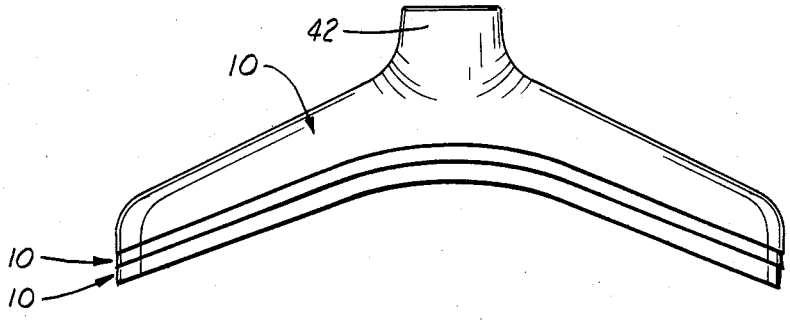
FIG. 7 is a side elevational view of a plurality of display hanger covers of the present invention nested for storage or shipment.

FIG. 7 shows a plurality of display hanger covers 10 of the present invention nested together in a stack, with the hollow interior of each receiving a portion of the external shape of the one below. This feature permits ready storage of the display hanger covers 10 in a minimum of space, and facilitates bulk shipment of same.

Figure 8:
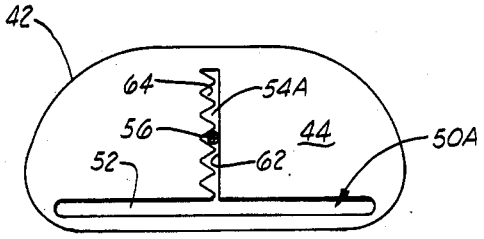
FIGS. 8 and 9 are views similar to FIG. 6 and show alternative configurations of the hook passage slot disposed in the neck portion of the display hanger cover of the present invention.

In FIG. 8, the upper surface 44 of the neck portion 42 is provided with a hook passage slot 50A which has the identical first slot portion 52 as described above for the hook passage slot 50, but has a variation second slot portion 54A. That is, the second slot portion 54A has a first side wall 62 and a second side wall 64, the second wall being serrated and in near juxtaposition to the first wall 62. Preferably, the upper planar surface 44 is comprised of a flexible material, such as a moldable plastic, such that the serrations along the second side wall 64 flexibly permit the passage of the profile of the upstanding portion 56 of the hanger hook 22 to be forcibly moved along the second slot portion 54A and to be biased to remain at any selected position therealong until again forcibly moved.

Figure 9:
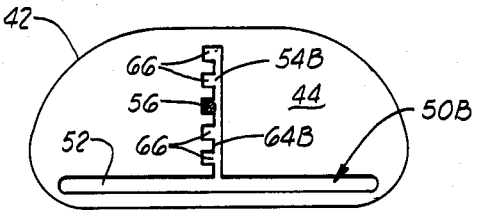

In FIG. 9 is yet another embodiment of the hook passage slot 50B in which the second slot portion 54B has a pluarlity of relief apertures 66 that take the form of notched areas along the second side wall 64B. The apertures 66 serve the same purpose as that described above for the plural apertures 58, 60 in FIG. 6.

The shoulder portions 36, 38 of the display hanger cover 10 serve as shoulder ramps that can be shaped as desired to substantially fill and support the contour of any selected garment. That is, the shoulder ramps of the display hanger cover 10 can be selectively shaped for men's suit coats, while another such cover can have shoulder ramps contoured to fit and support women's dresses. Of course, a general purpose display hanger cover 10 can be selected such that its shape will fit and support a wide selection of garments in simulated wearing mode.

The display hanger cover 10 can be made of any acceptable material, but preferably is molded of an elastomeric material, such as plastic, to have a firm but somewhat flexible wall texture. A much thicker wall, and thus firmer, may be desirable for a retail establishment, simply because of the greater wear encountered, while a thinner wall may be desirable for home wardrobe usage. The display hanger cover of the present invention should be a very durable product which is reusable for years and it should find numerous uses both commercially and domestically. Once placed over a hanger, the hanger passage slot is designed to grip the hanger hook until purposefully removed therefrom, so once installed, the display hanger cover and underlying hanger form a unitary support and attractive display stand for one's garments.

Figure 10:
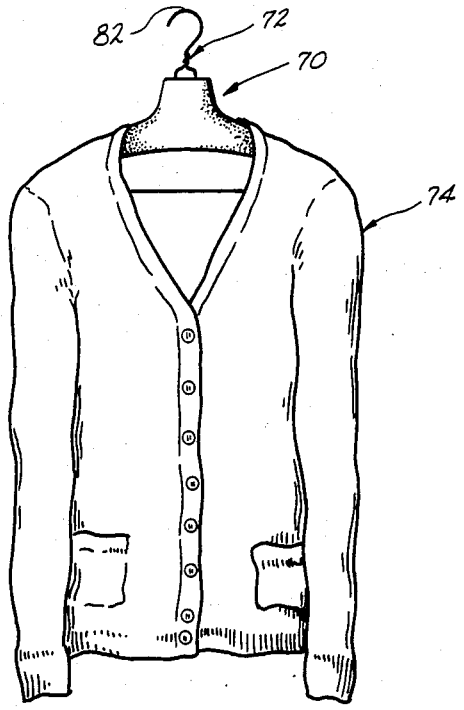
FIG. 10 is a side elevational view of a second embodiment of the display hanger cover of the present invention as supported by a wire hanger with a sweater depicted as hanging thereon.

Referring now to FIGS. 10–13, and more particularly to FIG. 10, shown therein is a second embodiment of a display hanger cover 70 constructed in accordance with the present invention. The display hanger cover 70 depicted in FIG. 10 shows a supporting wire hanger 72, which is of the type commonly known and used in the household, and a sweater 74 is supported by the combination of the display hanger cover 70 and the wire hanger 72.

Figure 11:
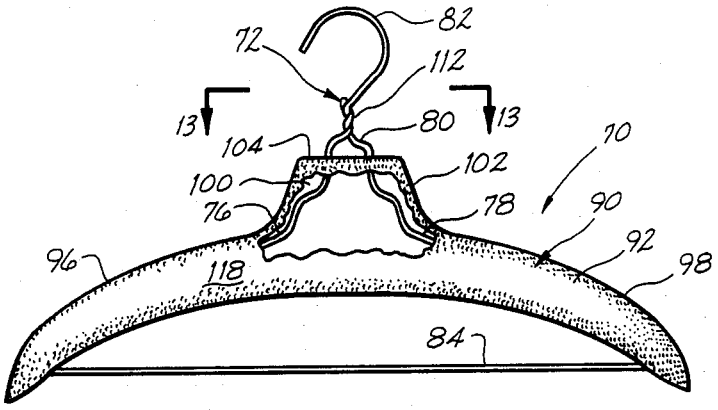
FIG. 11 is a side elevational, partial cutaway view showing the display hanger of the present invention as supported on a wire hanger.

As more clearly shown in FIG. 11, the display hanger 70 is supported by the wire hanger 72. The wire hanger 72 is a unitary member having oppositely disposed side arms 76 and 78 that are connected together to form a neck portion 80. An upwardly extensive hanger hook 82 extends from the neck portion 80 substantially as shown. The side arms 76 and 78 are connected to and support a lower carriage member 84 for the support of such garments as pants, slacks or skirts.

Figure 12:
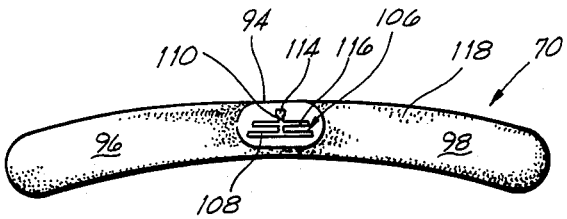
FIG. 12 is a top plan view of the display hanger cover shown in FIG. 11 having the wire hanger removed therefrom.
Figure 13:
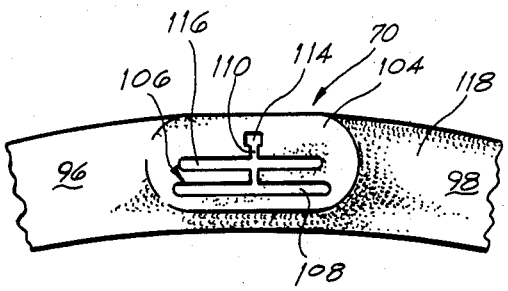
FIG. 13 is an enlarged view of the planar support surface as taken at 13—13 in FIG. 11 having the wire hanger removed therefrom.

Referring now to FIGS. 11–13, shown therein are side elevational and top plan views, respectively, of the display hanger cover 70. The display hanger cover 70 has an elongated body portion 90 that has a substantially curvilinearly shaped front wall 92 and a similarly shaped rear wall 94 which support oppositely disposed, substantially curvilinearly shaped first and second shoulder portions 96 and 98. The body portion 90 has a hollow interior 100 (see FIG. 11) which is open at its bottom, allowing the free entrance of the side arms 76, 78 of the wire hanger 72 such that the wire hanger 72 supports and stabilizes the display hanger 70 in the position depicted in FIG. 10 and 11.

The display hanger cover 70 also has a neck portion 102 which is supported at the confluence of the first and second shoulder portions 96, 98 and the front and rear walls 92, 94 of the body portion 90, and the neck portion 102 has a substantially planar upper surface 104. A hook passage slot 106 is disposed through the upper surface 104 of the neck portion 102 so as to communicate with the hollow interior 100 of the body portion 90. A first slot portion 108 of the hook passage slot 106 is generally shaped for passage therethrough of the planar profile of the hanger hook 82; that is, the first slot portion is a relatively thin, elongated slot which is dimensioned to permit the passage of the hanger hook 82 therethrough as the display hanger cover 10 is being disposed over the wire hanger 72, permitting passage of the hanger hook 82 with relative ease therethrough.

A second slot portion 110 of the hook passage slot 106 communicates with the first slot portion 108 and is generally disposed at a right angle, or normal, thereto. The dimensions, or width of the second slot portion 110 is such that an upstanding portion 112 of the hanger hook 82 (see FIGS. 10 and 11) can be pushed therealong. In the embodiment of the hook passage slot 106 depicted in FIGS. 12 and 13, a relief aperture 114 is disposed at the distal end of the second slot portion 110 and is dimensioned so as to generally receive the upstanding portion of a wishbone hanger, such as the upstanding portion 56 of the hanger hook 22 of the wishbone hanger 12 illustrated in FIG. 2, relative to the display hanger cover 70 when the latter is placed over the former. This permits the hollow interior 100 of the body portion 90 to cover various curvilinear configurations of the side arms of wishbone hangers, thus permitting the use of the display hanger cover 70 with many types of clothes hangers.

A third slot portion 116 of the hook passage slot 106 is disposed through the upper surface 104 so as to communicate with the hollow interior 100 of the body portion 90. The third slot portion 116 intersects the second slot portion 110 at a position substantially intermediate the first slot portion 108 and the relief aperture 114 and is substantially parallel to the first slot portion 108 substantially as shown. The length of the third slot portion 116 which is adapted to receive the neck portion 90 of the wire hanger 72 can vary widely, depending upon the width of the neck portion 80 the wire hanger 72, but is desirably substantially equal to the length of the first slot portion 108. Thus, when the display hanger cover 70 is positioned upon the wire hanger 72 the neck portion 80 of the wire hanger 72 is disposed through the third slot portion 116 such that the wire hanger 72 and the display hanger cover 70 are connected in a stable position. Further, the unique design of the display hanger cover 70 enables one not only to secure the display hanger cover 70 on the wire hanger 72 in a stable position, but provides a desired versatility in that the display hanger cover 70 can be secured on a wishbone hanger in a stable position.

An exterior surface 118 of the body portion 90 of the display hanger cover 70 is textured, to provide a gripping, but non-snagging, surface. The textured, exterior surface 118 serves to prevent the sweater 74 or other similar garments from sliding on the display hanger cover 70 and falling off of the display hanger cover 70.

In addition, the shoulder portions 96 and 98 of the display hanger cover 70 serve as shoulder ramps that can be shaped as desired to substantially fill and support the contour of any selected garment, such as the sweater 74, a coat, a dress and the like. That is, the shoulder portions 96 and 98 of the display hanger cover 70 can be selectively shaped for men's suit coats, while another such cover can have shoulder portions contoured to fit and support women's dresses, while yet another such cover can have shoulder portions contoured to fit and support sweaters. Of course, a general purpose display hanger cover 70 can be selected such that its shape will fit and support a wide selection of garments in simulated wearing mode.

The display hanger cover 70 can be made of any acceptable material, but preferably is molded of an elastomeric material, such as plastic, to have a firm but somewhat flexible wall texture. A much thicker wall, and thus firmer, may be desirable for a retail establishment, simply because of the greater wear encountered, while a thinner wall may be desirable for home wardrobe usage. Further, the exterior surface 118 of the body portion 90 of the display hanger cover 74 is preferably textured to provide a gripping surface for securing and supporting garments thereon. The display hanger cover 70 of the present invention should be a very durable product which is reusable for years and it should find numerous uses both commercially and domestically. Once placed over the wire hanger 72, the third slot portion 116 of the hook passage slot 106 is designed to receive the neck portion 80 of the wire hanger 72 and to stabilize the wire hanger 72 with relation to the display hanger cover 70 until purposefully removed therefrom, so once installed, the display hanger cover 70 and underlying wire hanger 72 form a unitary support and attractive display stand for one's garments.

It is clear that the present invention is well adapted to carry out the objects and to attain the ends and advantages mentioned as well as those inherent therein. While presently preferred embodiments of the invention have been described for purpose of this disclosure, it will be understood that numerous changes may be made which will readily suggest themselves to those skilled in the art and which are encompassed within the spirit of the invention disclosed and as defined in the following claims.

What I claim is:

1. An improved display hanger cover supportable over a clothes hanger to convert the clothes hanger to the utility of a display hanger for a garment, the clothes hanger having oppositely disposed side arms, a hanger neck portion and a hanger hook, the display hanger cover comprising:

an elongated body portion having a hollow interior open at its bottom, the body portion having substantially curvilinearly shaped front and rear walls disposed to be supported over the hanger side arms and having substantially curvilinearly shaped first and second shoulder portions supported by the front and rear walls; and a neck portion supported at the confluence of the first and second shoulder portions and the front and rear walls, the neck portion having a substantially planar upper surface and a hook passage slot communicating with the hollow interior of the body portion, a first slot portion of the hook passage slot being generally shaped for passage therethrough of the planar profile of the hanger hook, a second slot portion of the hook passage slot substantially normally disposed to the first slot portion thereof, the second slot portion dimensioned to permit passage and retention of the hanger hook therein, and a third slot portion of the hook passage slot communicating with the second slot portion and disposed substantially parallel to the first slot portion, the third slot portion dimensioned to receive the hanger neck portion of a wire hanger such that at least a portion of the neck portion of the wire hanger extends therethrough for securing and stabilizing the display hanger cover on the wire hanger.

2. The display hanger cover of claim 1 wherein the second slot portion of the hook passage slot has a relief aperture in the distal portion thereof to receive therethrough the hanger hook portion of a wishbone hanger so that the hanger hook is biased to remain at the relief aperture and secure and stabilize the display hanger cover on the wishbone hanger.

3. The display hanger cover of claim 2 wherein the first and second shoulder portions are configured to form garment support ramps that substantially support the garment in a simulated wearing mode thereof.

4. The display hanger cover of claim 3 wherein the exterior surface of the body portion is textured to prevent slipping of a garment thereon.

5. The display hanger cover of claim 7 wherein the third slot portion of the neck portion of the display hanger cover has a length substantially equal to the length of the first slot portion thereof.

6. The display hanger cover of claim 5 wherein the first and second shoulder portions are configured to form garment support ramps that substantially support the garment in a simulated wearing mode thereof.

7. The display hanger cover of claim 6 wherein the exterior surface of the body portion and first and second shoulder portions of the display hanger cover are textured to prevent slipping of a garment thereon.

* * * * *

UNITED STATES PATENT AND TRADEMARK OFFICE

CERTIFICATE OF CORRECTION

PATENT NO. : 4,658,997

DATED : April 21, 1987

INVENTOR(S) : Stacy B. Nash

It is certified that error appears in the above-identified patent and that said Letters Patent is hereby corrected as shown below:

In column 3, line 35, the line "FIG. 2 is a side elevational view of a prior art" should read --FIG. 2 is a side elevational view of a prior art wishbone hanger--. In column 5, line 35, the word "pluarlity" should read --plurality--.

Signed and Sealed this

Twenty-fourth Day of May, 1988

*Attest:*

DONALD J. QUIGG

*Attesting Officer*

*Commissioner of Patents and Trademarks*